US009881630B2

(12) United States Patent
Buchner et al.

(10) Patent No.: US 9,881,630 B2
(45) Date of Patent: Jan. 30, 2018

(54) ACOUSTIC KEYSTROKE TRANSIENT CANCELER FOR SPEECH COMMUNICATION TERMINALS USING A SEMI-BLIND ADAPTIVE FILTER MODEL

(71) Applicant: GOOGLE INC., Mountain View, CA (US)

(72) Inventors: Herbert Buchner, Cambridge (GB); Simon J. Godsill, Cambridge (GB); Jan Skoglund, Mountain View, CA (US)

(73) Assignee: GOOGLE LLC, Mountain View, CA (US)

( * ) Notice: Subject to any disclaimer, the term of this patent is extended or adjusted under 35 U.S.C. 154(b) by 115 days.

(21) Appl. No.: 14/984,373

(22) Filed: Dec. 30, 2015

(65) Prior Publication Data

US 2017/0194015 A1 Jul. 6, 2017

(51) Int. Cl.

| | |
|---|---|
| ***G10L 21/02*** | (2013.01) |
| ***G10L 19/26*** | (2013.01) |
| ***G10L 21/0224*** | (2013.01) |
| ***G10L 21/028*** | (2013.01) |
| *G10L 21/0216* | (2013.01) |
| *G10L 21/0208* | (2013.01) |
| *G10L 21/0232* | (2013.01) |

(52) U.S. Cl.

CPC ..... *G10L 19/26* (2013.01); *G10L 21/028* (2013.01); *G10L 21/0216* (2013.01); *G10L 21/0224* (2013.01); *G10L 21/0208* (2013.01); *G10L 21/0232* (2013.01); *G10L 2021/02161* (2013.01); *G10L 2021/02165* (2013.01); *H04R 2410/05* (2013.01)

(58) Field of Classification Search

None

See application file for complete search history.

(56) References Cited

U.S. PATENT DOCUMENTS 5,694,474 A * 12/1997 Ngo ..... G06K 9/0057 381/66
5,953,380 A * 9/1999 Ikeda ..... H03H 21/0012 375/232

(Continued)

OTHER PUBLICATIONS

T. Wolff and M. Buck, "A generalized view on microphone array postfilters", in Proc. Int'l. Workshop Acoustic Echo and Noise Control, Tel Aviv, Israel, 2010.*

(Continued)

*Primary Examiner* — Richard Zhu

(74) *Attorney, Agent, or Firm* — Young Basile Hanlon & MacFarlane, P.C.

(57) ABSTRACT

Provided are methods and systems for acoustic keystroke transient cancellation/suppression for user communication devices using a semi-blind adaptive filter model. The methods and systems are designed to overcome existing problems in transient noise suppression by taking into account some less-defective signal as side information on the transients and also accounting for acoustic signal propagation, including the reverberation effects, using dynamic models. The methods and systems take advantage of a synchronous reference microphone embedded in the keyboard of the user device, and utilize an adaptive filtering approach exploiting the knowledge of this keybed microphone signal.

20 Claims, 8 Drawing Sheets

(56) References Cited

U.S. PATENT DOCUMENTS

| | | | | |
|---|---|---|---|---|
| 6,002,776 | A * | 12/1999 | Bhadkamkar | G10K 11/178 379/406.16 |
| 6,266,422 | B1 | 7/2001 | Ikeda | |
| 6,516,050 | B1 * | 2/2003 | Tasaki | H04B 3/234 370/286 |
| 6,873,704 | B1 * | 3/2005 | Park | H04M 9/082 370/290 |
| 7,760,758 | B2 * | 7/2010 | Okello | H04B 7/0417 370/465 |
| 8,144,888 | B2 * | 3/2012 | Berkhoff | G10K 11/178 381/71.1 |
| 8,867,757 | B1 | 10/2014 | Ooi | |
| 9,633,670 | B2 * | 4/2017 | Fan | G10L 21/0208 |
| 2004/0193411 | A1 * | 9/2004 | Hui | G10L 15/20 704/233 |
| 2006/0271354 | A1 * | 11/2006 | Sun | G10L 19/26 704/205 |
| 2007/0258353 | A1 * | 11/2007 | Okello | H04B 7/0417 370/204 |
| 2008/0019434 | A1 * | 1/2008 | Kim | H04B 1/71072 375/232 |
| 2009/0210227 | A1 * | 8/2009 | Sugiyama | G10L 15/22 704/246 |
| 2010/0183067 | A1 * | 7/2010 | Garcia | G10L 19/26 375/240 |
| 2012/0045069 | A1 * | 2/2012 | Sun | G10L 21/0208 381/66 |
| 2014/0243048 | A1 * | 8/2014 | Kwan | G10L 21/0208 455/570 |
| 2014/0301558 | A1 | 10/2014 | Fan | |

OTHER PUBLICATIONS

E. Habets and S. Gannot, "Dual-Microphone Speech Dereverberation using a Reference Signal", in Proc. of the IEEE Int'l. Conference on Acoustics, Speech, and Signal Processing, Honolulu, USA, Apr. 2007, vol. IV, pp. 901-904.*

Yushan Li, et al., "New approach to Blind Deconvolution of Single Input Multiple Output linear FIR System", IEEE, 2001, pp. 741-746.*

Benesty, J. "Adaptive eigenvalue decomposition algorithm for passive acoustic source localization," J. Acoust. Soc. Am. 107:384-391 (Jan. 2000).

Breining et al., "Acoustic echo control—an application of very-high-order adaptive filters," IEEE Signal Processing Magazine, pp. 42-69 (Jul. 1999).

Buchner et al., "Multichannel frequency-domain adaptive filtering with application to acoustic echo cancellation," in Adaptive signal processing: Application to real-world problems, J. Benesty and Y. Huang, Eds. Berlin: Springer pp. 95-128 (Jan. 2003).

Buchner et al., "Robust extended multidelay filter and double-talk detector for acoustic echo cancellation," IEEE Trans. Speech Audio Processing 14:5:1633-1644 (Sep. 2006).

Buchner et al., "TRINICON: A versatile framework for multichannel blind signal processing," in Proc. IEEE Int. Conf. on Acoustics, Speech, and Signal Processing (ICASSP), Montreal, Canada 3:889-892 (May 2004).

Buchner, H. & K. Helwani, "On the relation between blind system identification and subspace tracking and associated generalizations," in Proc. Asilomar Conference on Signals, Systems, and Computers, Pacific Grove, CA, USA (Nov. 2010).

Buchner, H. & W. Kellermann, "A fundamental relation between blind and supervised adaptive filtering illustrated for blind source separation and acoustic echo cancellation," in Proc. Joint Workshop on Hands-Free Speech Communication and Microphone Arrays (HSCMA), Trento, Italy, May 2008.

Erkelens, J. & R. Heusdens, "Tracking of nonstationary noise based on data driven recursive noise power estimation," IEEE Trans. Audio, Speech, and Language Processing, 16:6:1112-1123 (Aug. 2008).

Gansler et al., "Double-talk robust fast converging algorithms for network echo cancellation," IEEE Trans. Speech Audio Processing 8:656-663 (Nov. 2000).

Godsill et al., "Detection and suppression of keyboard transient noise in audio streams with auxiliary keybed microphone," in Proc. IEEE Int. Conf. on Acoustics, Speech, and Signal Processing (ICASSP), Brisbane, Australia, Apr. 2015.

Godsill, S., "The shifted inverse-gamma model for noise-floor estimation in archived audio recordings," Signal Processing, 90:991-999 (2010).

Gurelli, N. & C. Nikias, "EVAM: an eigenvector-based algorithm for multichannel blind deconvolution of input colored signals," IEEE Trans. Signal Processing, 43:1:134-149 (Jan. 1995).

Kellermann et al., "Multichannel acoustic signal processing for human/machine interfaces—fundamental problems and recent advances," in Conf. Rec. 18th Int. Congress on Acoustics, Kyoto, Japan, Apr. 2004.

Martin, R. "Noise power spectral density estimation based on optimal smoothing and minimum statistics," IEEE Trans. Speech and Audio Processing 9:5:504-512 (Jul. 2001).

Meisinger, K & A. Kaup, "Spatiotemporal selective extrapolation for 3-D signals and its applications in video communications," IEEE Trans. on Image Processing, 16:9:2348-2360 (Sep. 2007).

Mohammadiha, N. & S. Doclo, "Transient noise reduction using nonnegative matrix factorization," in Proc. Joint Workshop on Hands-Free Speech Communication and Microphone Arrays (HSCMA), Nancy, France, May 2014.

Raj et al., "Reconstruction of missing features for robust speech recognition," Speech Communication, 43:275-296 (2004).

Soo, J. S. & K. Pang, "Multidelay block frequency domain adaptive filter," IEEE Trans. Acoust., Speech, Signal Processing, 38:373-376 (Feb 1990).

Subramanya et al., "Automatic removal of typed keystrokes from speech signals," IEEE SP Letters, 14:5:363-366 (May 2007).

Sugiyama, A. "Single-channel impact-noise suppression with no auxiliary information for its detection," in Proc. IEEE Workshop on Applications of Signal Processing to Audio and Acoustics (WASPAA), New Paltz, NY, USA, Oct. 2007.

Sugiyama, A.& R. Miyahara, "Tapping-noise suppression with magnitude weighted phase-based detection," in Proc. IEEE Workshop on Applications of Signal Processing to Audio and Acoustics (WASPAA), New Paltz, NY, USA, Oct. 2013.

Buchner, et al., "An Acoustic Keystroke Transient Canceler for Speech Communication Terminals Using a Semi-Blind Adaptive Filter Model", 2016 IEEE International Conference on Acoustics, Speech and Signal Processing, IEEE, Mar. 20, 2016. pp. 614-618.

* cited by examiner

500

| Requirements | Signal-based Approach | System-based Approach |
|---|---|---|
| Low Distortion | ! | + |
| Tracking/ Convergence Speed | + | +! |
| Cope with Nonlinearities | + | ! |
| Crosstalk in the reference signal | +! | +! |
| Adaptation Control (double-talk) | +! | +! |

FIG. 5

ACOUSTIC KEYSTROKE TRANSIENT CANCELER FOR SPEECH COMMUNICATION TERMINALS USING A SEMI-BLIND ADAPTIVE FILTER MODEL

BACKGROUND

In audio and/or video conferencing environments it is common to encounter annoying keyboard typing noise, both simultaneously present with speech and in the "silent" pauses between speech. Typical scenarios are where someone participating in a conference call is taking notes on their laptop computer while the meeting is taking place, or where someone checks their emails during a voice call. It can be particularly annoying or disturbing to users when this type of noise is present in audio data.

SUMMARY

This Summary introduces a selection of concepts in a simplified form in order to provide a basic understanding of some aspects of the present disclosure. This Summary is not an extensive overview of the disclosure, and is not intended to identify key or critical elements of the disclosure or to delineate the scope of the disclosure. This Summary merely presents some of the concepts of the disclosure as a prelude to the Detailed Description provided below.

The present disclosure generally relates to methods and systems for signal processing. More specifically, aspects of the present disclosure relate to suppressing transient noise in an audio signal using input from an auxiliary microphone as a reference signal.

One embodiment of the present disclosure relates to a system for suppressing transient noise, the system comprising: a plurality of input sensors that input audio signals captured from one or more sources, where the audio signals contain voice data and transient noise captured by the input sensors; a reference sensor that inputs a reference signal containing data about the transient noise, where the reference sensor is located separately from the input sensors; and a plurality of filters that selectively filter the transient noise from the audio signals to extract the voice data based on the data contained in the reference signal, and output an enhanced audio signal containing the extracted voice data.

In another embodiment, the plurality of filters in the system for suppressing transient noise includes an adaptive foreground filter, and an adaptive background filter, where the foreground filter adaptively filters the transient noise to produce the enhanced output audio signal, and the background filter controls the adaptation of the foreground filter.

Another embodiment of the present disclosure relates to a method for suppressing transient noise, the method comprising: receiving, from a plurality of input sensors, input audio signals captured from one or more sources, wherein the audio signals contain voice data and transient noise captured by the input sensors; receiving, from a reference sensor, a reference signal containing data about the transient noise, wherein the reference sensor is located separately from the input sensors; selectively filtering the transient noise from the audio signals to extract the voice data based on the data contained in the reference signal; and outputting an enhanced audio signal containing the extracted voice data.

In another embodiment, the method for suppressing transient noise further comprises adapting a foreground filter to adaptively filter the transient noise to produce the enhanced output audio signal.

In another embodiment, the method for suppressing transient noise further comprises controlling the adaptation of the foreground filter using a background filter.

In one or more other embodiments, the methods and systems described herein may optionally include one or more of the following additional features: each of the filters is a broadband finite impulse response filter; the transient noise is selectively filtered from the audio signals using broadband finite impulse response filters; the background filter controls the adaptation of the foreground filter based on the data contained in the reference signal; the background filter controls the adaptation of the foreground filter in response to transient noise being detected in the audio signals; the background filter controls the adaptation of the foreground filter based on one or more of a power of the reference signal, a ratio of a linear approximation to the nonlinearity contribution of the reference signal, and spatio-temporal source signal activity data associated with the reference signal; the background filter controls the adaptation of the foreground filter based on a power of the reference signal, a ratio of a linear approximation to the nonlinearity contribution of the reference signal, and spatio-temporal source signal activity data associated with the reference signal; the transient noise contained in the audio signals is a keystroke noise generated from a keybed of a user device; the input sensors and the reference sensor are microphones; and/or the plurality of filters filter the transient noise from the audio signals by subtracting the reference signal input from the reference sensor.

Further scope of applicability of the present disclosure will become apparent from the Detailed Description given below. However, it should be understood that the Detailed Description and specific examples, while indicating preferred embodiments, are given by way of illustration only, since various changes and modifications within the spirit and scope of the disclosure will become apparent to those skilled in the art from this Detailed Description.

BRIEF DESCRIPTION OF DRAWINGS

These and other objects, features and characteristics of the present disclosure will become more apparent to those skilled in the art from a study of the following Detailed Description in conjunction with the appended claims and drawings, all of which form a part of this specification. In the drawings:

FIG. 5 is a table illustrating example requirements for signal-based and system-based approaches for signal enhancement according to one or more embodiments described herein.

Figure 1:
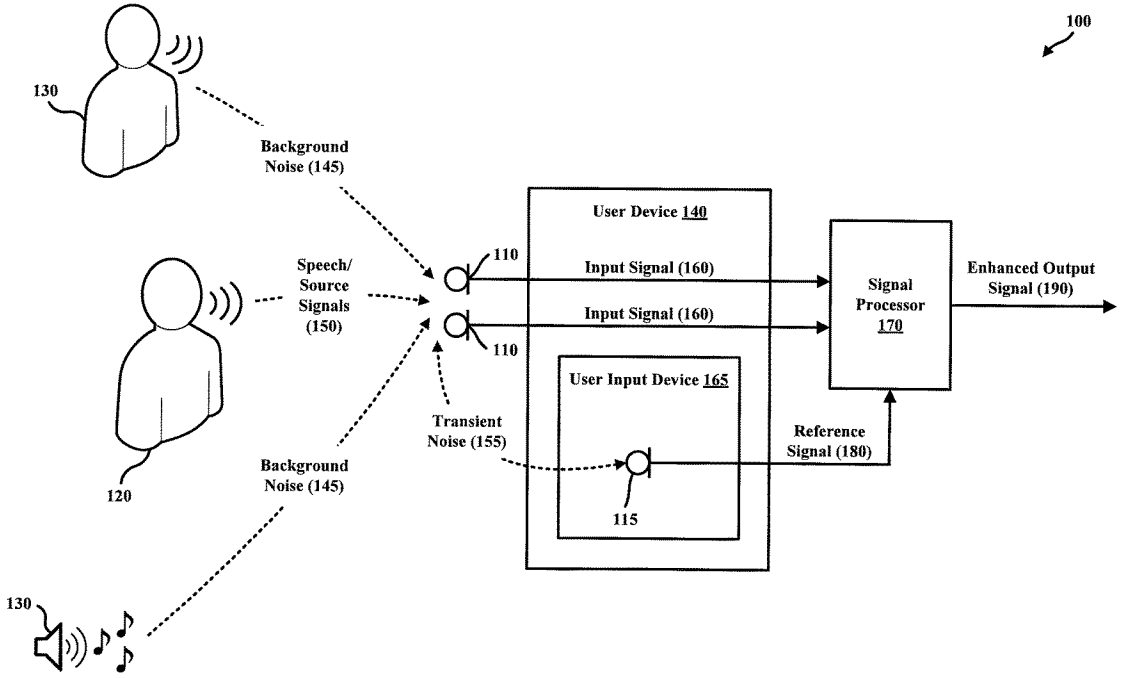
FIG. 1 is a schematic diagram illustrating an example application for transient noise suppression using input from an auxiliary microphone as a reference signal according to one or more embodiments described herein.

The headings provided herein are for convenience only and do not necessarily affect the scope or meaning of what is claimed in the present disclosure.

In the drawings, the same reference numerals and any acronyms identify elements or acts with the same or similar structure or functionality for ease of understanding and convenience. The drawings will be described in detail in the course of the following Detailed Description.

DETAILED DESCRIPTION

Overview

Various examples and embodiments will now be described. The following description provides specific details for a thorough understanding and enabling description of these examples. One skilled in the relevant art will understand, however, that one or more embodiments described herein may be practiced without many of these details. Likewise, one skilled in the relevant art will also understand that one or more embodiments of the present disclosure can include many other obvious features not described in detail herein. Additionally, some well-known structures or functions may not be shown or described in detail below, so as to avoid unnecessarily obscuring the relevant description.

The rapid increase in availability of high speed internet connections has made personal computing devices a very popular basis for teleconferencing applications. While the embedded microphones, loudspeakers and webcams in laptop or tablet computers make setting up conference calls very easy, the resulting acoustic hands-free communication scenario generally brings with it the need for a number of challenging and interrelated signal processing problems, such as, for example, acoustic echo control, signal separation/extraction from background noise or other competing sources, and, ideally, dereverberation.

A specific type of acoustic noise that has become a particularly persistent problem, and which is addressed by the methods and systems of the present disclosure, is the impulsive noise caused by keystroke transients, especially when using the embedded keyboard of a laptop computer during teleconferencing applications (e.g., in order to make notes, write e-mails, etc.). In such a scenario, this impulsive noise in the microphone signals can be a significant nuisance due to the spatial proximity between the microphones and the keyboard, and partly due to possible vibration effects and solid-borne sound conduction within the device casing.

As discussed above, users find it disruptive and annoying when keyboard typing noise is present during an audio and/or video conference. Therefore, it is desirable to remove such noise without introducing perceivable distortions to the desired speech. Accordingly, the present disclosure provides new and novel signal enhancement methods and systems specifically for semi-supervised acoustic keystroke transient cancellation.

The following sections will clarify and analyze the signal processing problem in greater detail, and then focus on a specific class of approaches characterized by the use of broadband adaptive FIR filters. In addition, various aspects of the semi-supervised/semi-blind signal processing problem will be described in the context of a user device (e.g., a laptop computer) that includes an additional reference sensor underneath the keyboard. As will be described, in this context, the semi-supervised/semi-blind signal processing problem can be regarded as a new class of adaptive filtering problems in the hands-free context in addition to the already more extensively studied classes of problems in this field.

Many existing single-channel speech enhancement methods are typically based on noise power estimation and spectral amplitude modification in the short-time Fourier transform (STFT) domain. However, reducing highly non-stationary noise such as keystroke transients remains a challenging problem for many approaches of this type. The application of separation methods such as, for example, non-negative matrix factorization (NMF) in the spectral domain has shown promising results for impulsive noise. While such an approach can be effective where long signal samples are available, particularly for batch estimation, unfortunately, in practice there is very little adaptation time available due to the short activity of the key stroke transients and the variations of the acoustic click events. It is also important to note that the keyboard noise is broadband with its dominant frequency components typically in the same range as that of the speech signal. Due to such challenging conditions, this signal processing problem has been mainly addressed by missing feature approaches. Similar approaches are also known from image and video processing Similar to the speech enhancement methods mentioned above, the missing feature-type approaches typically require very accurate detections of the keystroke transients. Moreover, in the case of keystroke noise, this detection problem is exacerbated by both the reverberation effects and the fact that each keystroke actually leads to two audible clicks with unknown and varying distance, whereby the peak of the second click is often buried entirely in the overlapping speech signal (the first click occurs due to the actual keystroke and the second click occurs after releasing the key).

It should also be noted that simply using the typing information from the operating system of the device is usually not accurate enough as the temporal deviation between the typing information registered by the operating system (OS) and the actual acoustic event can vary widely and is not deterministic.

To further illustrate the signal processing problems, the following describes some measured keystroke transient noise signals (e.g., using a user device configured with the internal microphones on top of its display) under different reverberant conditions and different typing speeds.

Figure 2:
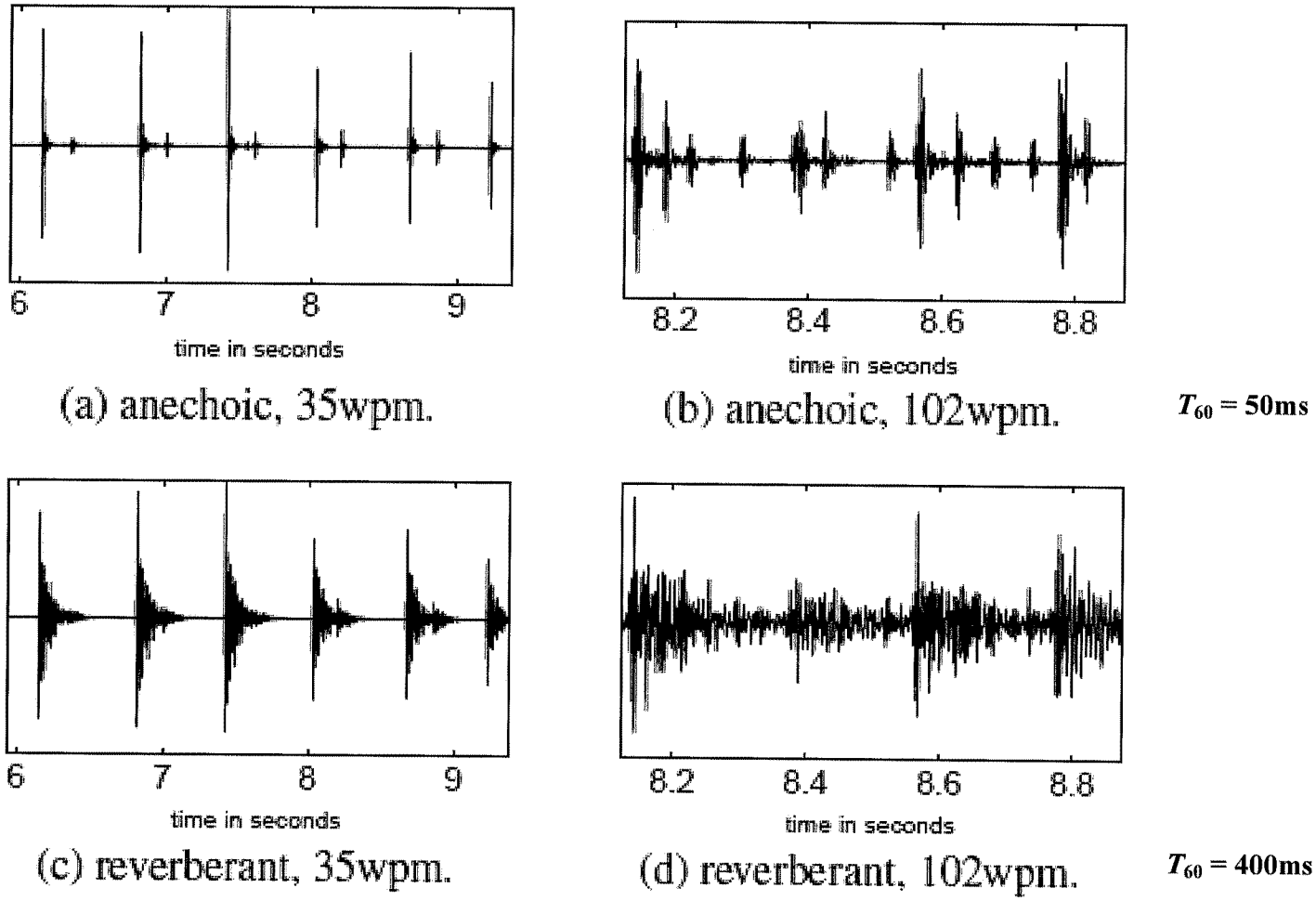
FIG. 2 is a set of graphical representations illustrating keyboard transient noise under different reverberant conditions and different typing speeds.

Typing speeds are commonly measured in number of words per minute (wpm) where by definition one "word" consists of five characters. It should be understood that each character consists of two keystroke transients. Based on various studies of computer users of different skill level and purpose, 40 wpm has emerged as a general rule of thumb for the touch typing speed on a typical QWERTY keyboard of a laptop computer. As 40 wpm corresponds to 6.7 keystroke transients per second, the average distance between the keystrokes can sometimes be as low as 150 ms (milliseconds). The example signals shown in FIG. 2 confirm this approximation, where the measurement of plot (a) was performed in an anechoic environment (e.g., the cabin of a car). The transients of both the downward and upward movements of the keys are clearly visible in plot (a). In contrast, as shown in plots (b), (c), and (d), signal reconstruction generally becomes more and more challenging with increasing typing speed and/or increasing room reverberation causing the effects of the keystrokes to overlap.

Moreover, in reverberant environments (e.g., plots (c) and (d)), the click noise is likely to extend over multiple analysis blocks.

The methods and systems of the present disclosure are designed to overcome existing problems in transient noise suppression for audio streams in portable user devices (e.g., laptop computers, tablet computers, mobile telephones, smartphones, etc.). For example, the methods and systems described herein may take into account some less-defective signal as side information on the transients (e.g., keystrokes) and also account for acoustic signal propagation, including the reverberation effects, using dynamic models. As will be described in greater detail below, the methods and systems provided are designed to take advantage of a synchronous reference microphone embedded in the keyboard of the user device (which may sometimes be referred to herein as the "keybed" microphone), and utilize an adaptive filtering approach exploiting the knowledge of this keybed microphone signal.

In accordance with one or more embodiments described herein, one or more microphones associated with a user device records voice signals that are corrupted with ambient noise and also with transient noise from, for example, keyboard and/or mouse clicks. The user device also includes a synchronous reference microphone embedded in the keyboard of the user device, which allows for measurement of the key click noise substantially unaffected by the voice signal and ambient noise. Such a setup allows for more powerful, semi-supervised keystroke transient suppression, such as that described in accordance with the present disclosure.

FIG. 1 illustrates an example 100 of such an application, where a user device 140 (e.g., laptop computer, tablet computer, etc.) includes one or more primary audio capture devices 110 (e.g., microphones), a user input device 165 (e.g., a keyboard, keypad, keybed, etc.), and an auxiliary (e.g., secondary or reference) audio capture device 115.

The one or more primary audio capture devices 110 may capture speech/source signals (150) generated by a user 120 (e.g., an audio source), as well as background noise (145) generated from one or more background sources of audio 130. In addition, transient noise (155) generated by the user 120 operating the user input device 165 (e.g., typing on a keyboard while participating in an audio/video communication session via user device 140) may also be captured by audio capture devices 110. For example, the combination of speech/source signals (150), background noise (145), and transient noise (155) may be captured by audio capture devices 110 and input (e.g., received, obtained, etc.) as one or more input signals (160) to a signal processor 170. In accordance with at least one embodiment the signal processor 170 may operate at the client, while in accordance with at least one other embodiment the signal processor may operate at a server in communication with the user device 140 over a network (e.g., the Internet).

The auxiliary audio capture device 115 may be located internally to the user device 140 (e.g., on, beneath, beside, etc., the user input device 165) and may be configured to measure interaction with the user input device 165. For example, in accordance with at least one embodiment, the auxiliary audio capture device 115 measures keystrokes generated from interaction with the keybed. The information obtained by the auxiliary microphone 115 may then be used to better restore a voice microphone signal which is corrupted by key clicks (e.g., input signal (160), which may be corrupted by transient noises (155)) resulting from the interaction with the keybed. For example, the information obtained by the auxiliary microphone 115 may be input as a reference signal (180) to the signal processor 170.

As will be described in greater detail below, the signal processor 170 may be configured to perform transient suppression/cancellation on the received input signal (160) (e.g., voice signal) using the reference signal (180) from the auxiliary audio capture device 115. In accordance with one or more embodiments, the transient suppression/cancellation performed by the signal processor 170 may be based on broadband adaptive multiple input multiple output (MIMO) filtering.

The methods and systems of the present disclosure have numerous real-world applications. For example, the methods and systems may be implemented in computing devices (e.g., laptop computers, tablet computers, etc.) that have an auxiliary microphone located beneath the keyboard (or at some other location on the device besides where the one or more primary microphones are located) in order to improve the effectiveness and efficiency of transient noise suppression processing that may be performed. In one or more other examples, the methods and systems of the present disclosure may be used in mobile devices (e.g., mobile telephones, smartphones, personal digital assistants, (PDAs)) and in various systems designed to control devices by means of speech recognition.

With the available reference signal (e.g., reference signal 180 in the example system 100 shown in FIG. 1) and the application of adaptive filtering, it may appear that the problem addressed by the methods and systems of the present disclosure is similar to a conventional acoustic echo cancellation (AEC) problem or an interference cancellation problem. However, there are notable differences between the keystroke transient suppression methods and systems described herein and existing AEC and/or interference cancellation approaches, some of which are illustrated in table 500 shown in FIG. 5 and reflected by the following:

(i) The "echo path" to be identified is rapidly time varying.

(ii) The excitation (keystroke transients) of the "echo path" is typically very short, meaning that the amount of data for the estimation process is limited.

(iii) There is cross-talk of low (but noticeable) power from the speech source into the keybed microphone.

(iv) Double-talk control (or double-talk detection in particular), as in conventional AEC is not straightforward in the situations addressed by the methods and systems described herein (mainly due to (iii) and (v)).

(v) Highly nonlinear systems. Experiments have shown that the acoustic paths from the keyboard to the microphones contain significant nonlinear contributions due to the solid-borne sound conduction within the casing. The nonlinear contributions (e.g., rattling) also exhibit a significant memory.

(vi) The system/method should have low complexity despite the challenges of (i)-(v).

Keystroke Transient Cancellation Based on Broadband Adaptive MIMO Filtering

Figure 3:
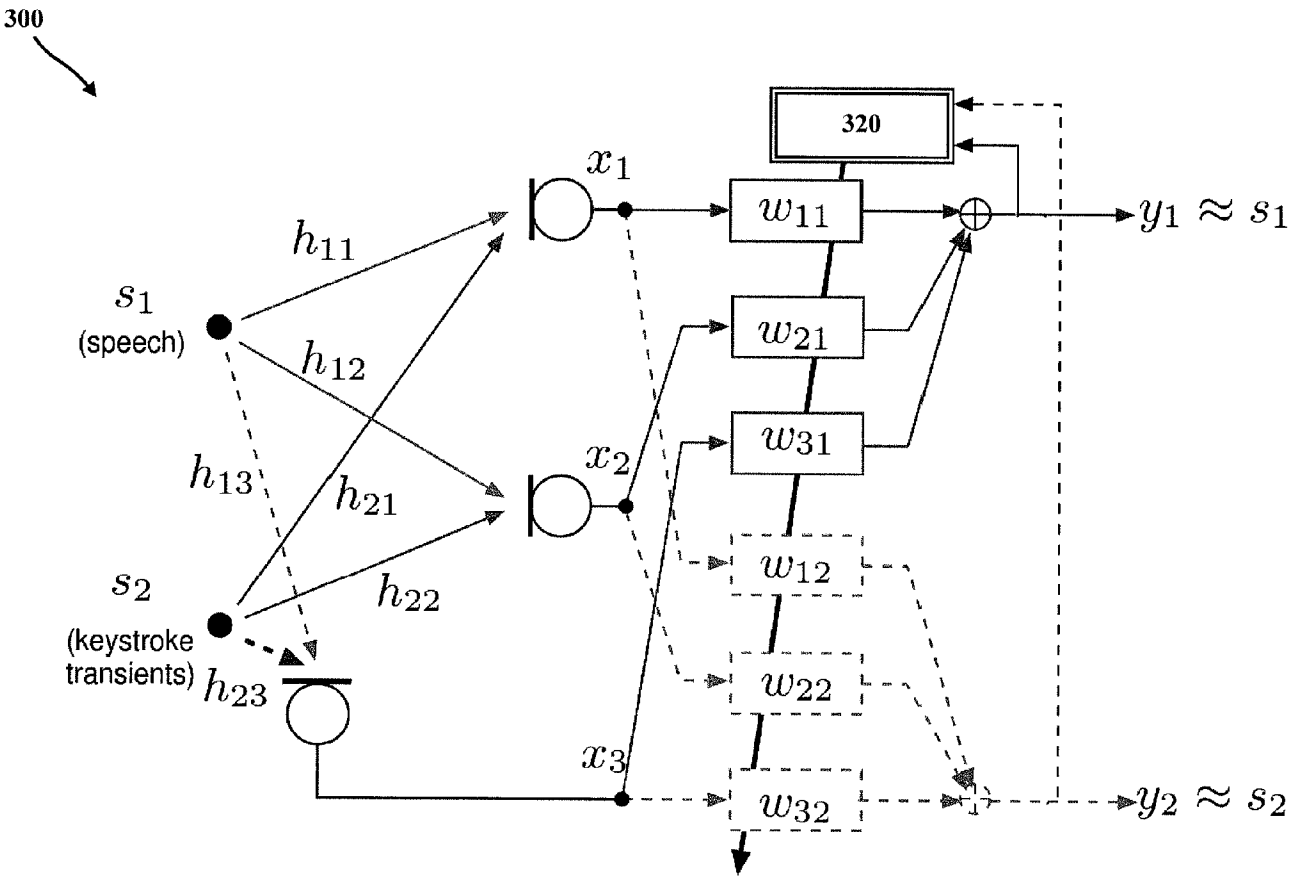
FIG. 3 is a block diagram illustrating an example system with multiple input channels and multiple output channels for extracting a desired speech signal according to one or more embodiments described herein.

The following provides details about the keystroke transient suppression/cancellation methods and systems of the present disclosure, which are designed to handle the above challenges (i)-(vi) for keystroke transient suppression, and also describes some example performance results in accordance therewith. The following sections develop the signal processing approach starting with a generic adaptive dynamical system with multiple input channels and multiple output channels (MIMO) for extracting the desired speech signal, an example of which is illustrated in FIG. 3. In particular, FIG. 3 shows an example of the system considered as a generic 2×3 source separation problem.

Figure 4:
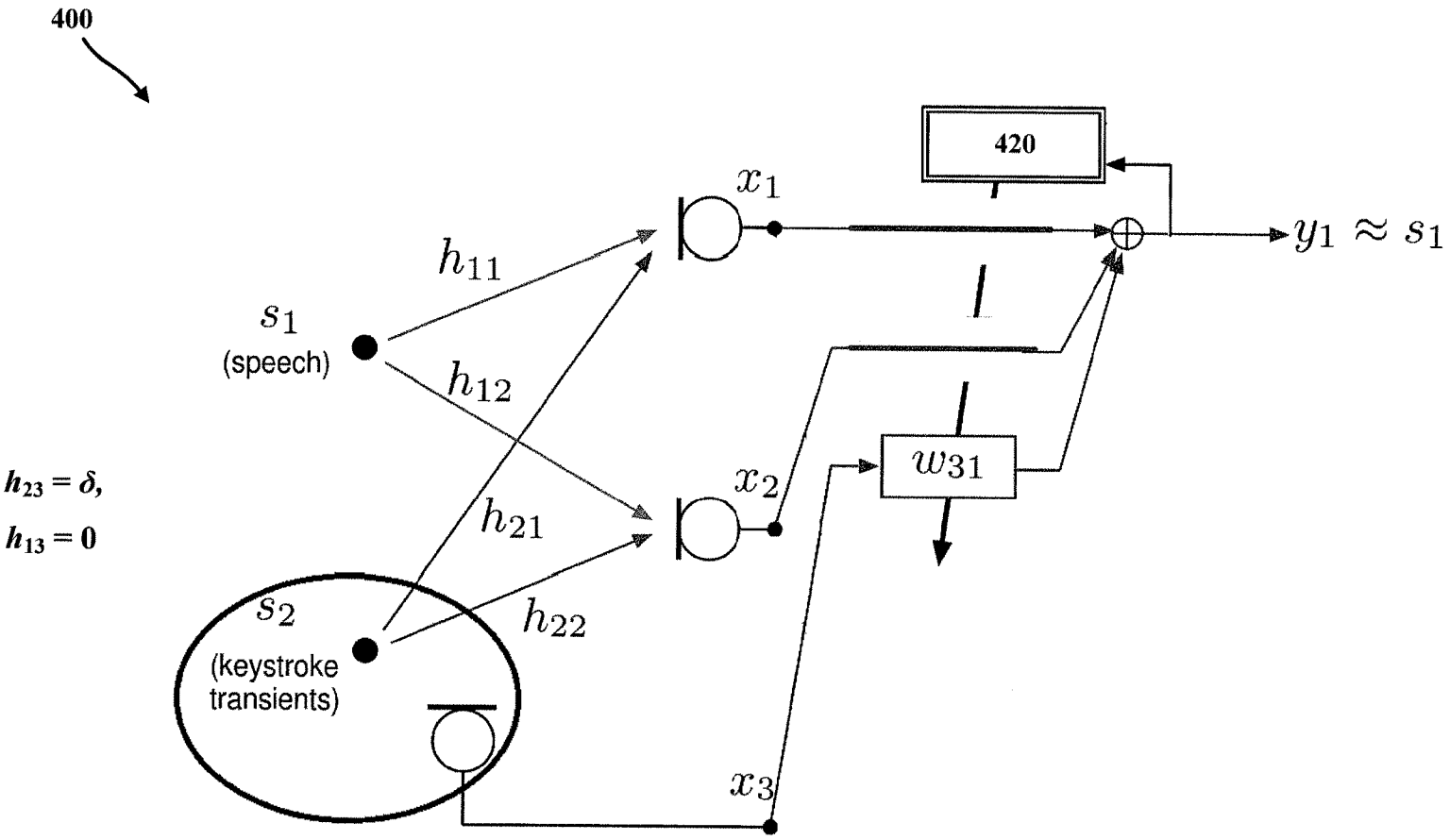
FIG. 4 is a block diagram illustrating an example supervised adaptive filter structure according to one or more embodiments described herein.
Figure 6:
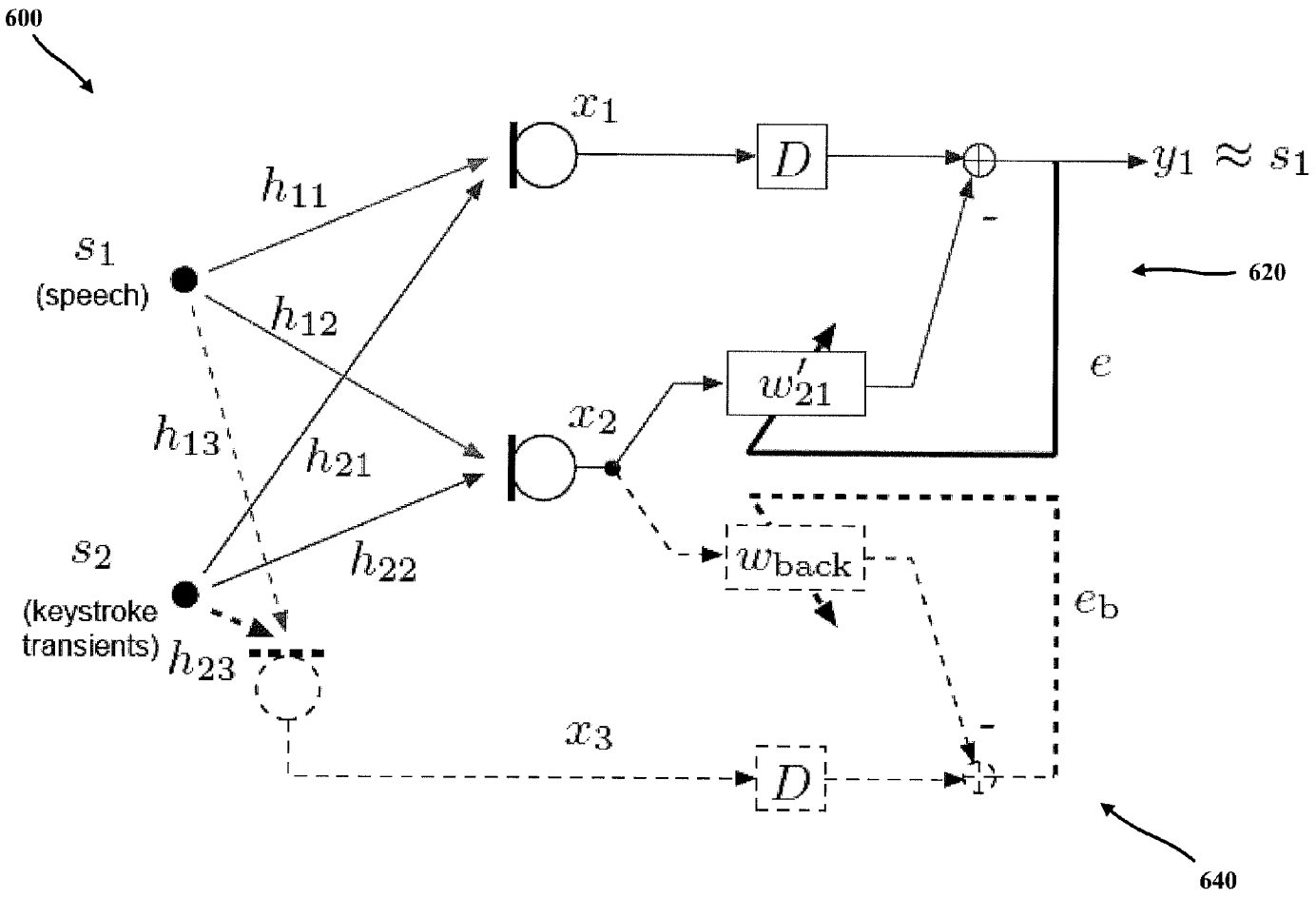
FIG. 6 is a block diagram illustrating an example system for semi-supervised acoustic keystroke transient suppression according to one or more embodiments described herein.
Figure 7:
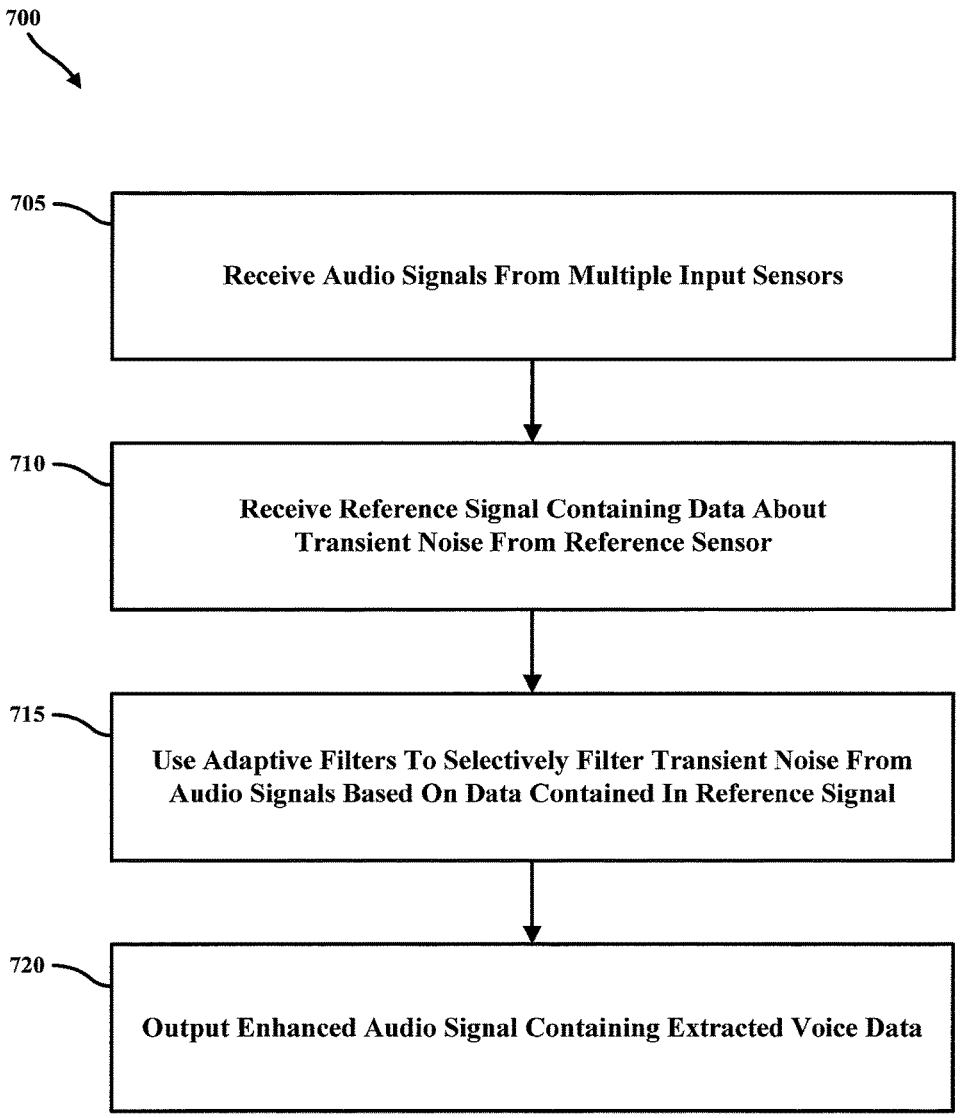
FIG. 7 is a flowchart illustrating an example method for semi-blind acoustic keystroke transient suppression according to one or more embodiments described herein.

While FIG. 3 shows an example system 300 with multiple input channels and multiple output channels, FIGS. 4 and 6 illustrate more specific arrangements in accordance with one or more embodiments of the present disclosure. In particular, FIG. 4 shows an example system 400 that corresponds to a supervised adaptive filter structure, and FIG. 6 shows an example system 600 that corresponds to a slightly modified version of a semi-blind adaptive SIMO filter structure (more specifically, FIG. 6 illustrates a semi-blind adaptive SIMO filter structure with equalizing post-filter).

With respect to the example systems shown in FIGS. 3, 4, and 6, it should be noted that paths represented by $h_{ij}$ (e.g., $h_{11}$, $h_{12}$, $h_{21}$, etc.) denote acoustic propagation paths from the sound sources $s_i$ to the audio input devices $x_j$ (e.g., microphones). In the descriptions that follow, it is assumed that the linear contribution of these propagation paths $h_{ij}$ can be described by impulse responses $h_{ij}(n)$. Also, blocks identified by $w_{ji}$ denote adaptive finite impulse response (FIR) filters with impulse responses $w_{ji}(n)$.

It should be understood that, in contrast to existing approaches for acoustic keystroke transient cancellation, the methods and systems of the present disclosure use adaptive FIR filters. In general, the FIR filters included in the example systems shown in FIGS. 3, 4, and 6 (e.g., blocks denoted by $w_{ji}$ in example systems 300, 400, and 600, respectively) may be described by the following filter equation:

$$y_{qp}(n) = \sum_{l=0}^{L-1} x_p(n-l) w_{pq,l},$$

which is reproduced below as equation (2). The details of filter equation (2) are provided in a later section.

The coefficients of the MIMO system (impulse responses in the linear case) are regarded as latent variables. These latent variables are assumed to have less variability over multiple time frames of the observed data. As they allow for a global optimization over longer data sequences, latent variable models have the well-known advantage of reducing the dimensions of data, making it easier to understand and, thus, in the present context, reduce or avoid distortions in the output signals. In the following, this approach may be referred to as "system-based" optimization in contrast to the "signal-based" approaches also described below. It should be noted that in practice it is often useful to combine signal-based and system-based approaches for signal enhancement, and thus an example of how to combine such approaches in the present context will be described in detail as well.

The system-based optimization approach of the present disclosure will be developed through the description of different conceivable adaptive filtering configurations as specializations of the generic MIMO case. This development will be facilitated by a general framework for broadband adaptive MIMO filtering, further described below, and guided by the example requirements (i)-(vi).

Supervised Adaptive Filter Structure

As described above, the simplest case exploiting the available keyboard reference signal $x_3$ would be the AEC structure. Indeed, the AEC structure and the various known supervised techniques can be regarded as a specialized case of the framework for broadband adaptive MIMO filtering. In the particular setup of the present disclosure (after the setup illustrated in FIG. 3), the corresponding assumptions may read $h_{13}(n) \equiv 0$, $h_{23}(n) = \delta(n)$. This means that this approach assumes a direct connection between the actual keystroke transients $s_2$ and the input $x_3$ of the filter $w_{31}$.

Typically, the resulting supervised adaptation process, based on this direct access to the interfering keyboard reference signals $s_2(n)$ without cross-talk from any other sources $s_1(n)$, as shown in FIG. 4, is very simple and robust, and as this approach just subtracts the appropriately filtered keyboard reference, it does not introduce distortions to the desired speech signals. Moreover, a closely related technique known as acoustic echo suppression (AES) has been shown to be particularly attractive for rapidly time varying systems. One existing approach for low-complexity AES, which inherently includes double-talk control and a distortion-less constraint, is an attractive candidate to fulfill the requirements (i), (ii), (iv), and (vi). However, such an existing AEC/AES-like structure ignores the requirements (iii) and (v), which turn out to be important in the present context and application. It has been shown that all the acoustic paths $h_{21}$, $h_{22}$, $h_{23}$ are in fact nonlinear due to the solid-borne sound conduction within the casing. In accordance with one or more embodiments of the present disclosure, the methods and systems described herein are designed to avoid nonlinear AEC due to complexity (vi) and numerical reasons (v).

It should be noted that requirement (iii) also makes the adaptation control significantly more difficult than in conventional AEC, as the reference signal (e.g., filter input) $x_3$ is no longer statistically independent from the speech signal $S_1$ (requirement (iv)). This contradicts the common assumptions in supervised adaptive filtering theory and the common strategies for double-talk detection.

Semi-Blind Adaptive SIMO Filter Structure

Typically, in practice, the relation between $x_1$, $x_2$ is closer to linearity than the relation between $x_3$, $x_1$ and the relation between $x_3$, $x_2$, respectively (see the example system shown in FIG. 3). This would motivate a blind spatial signal processing using the two array microphones $x_1$, $X_2$.

On the other hand, $x_3$ still contains significantly less crosstalk and less reverberation due to the proximity between the keyboard and the keyboard microphone. Therefore, the keyboard microphone is best suited for guiding the adaptation. In other words, while the core process is adapted blindly, the overall system can be considered as a semi-blind system. The guidance of the adaptation using the keyboard microphone addresses both the double-talk problem and the resolution of the inherent permutation ambiguity concerning the desired source in the output of blind adaptive filtering methods.

With the detection information inferred from the keyboard microphone signal (which will be described in greater detail below), an approximate decoupling of the optimization criterion with respect to the two output signals $y_1$ and $y_2$ is possible. This decoupling allows again a pruning of the full MIMO structure according to FIG. 3, and the resulting structure can again be regarded as a specialized case of the known framework for broadband adaptive MIMO filtering. The resulting structure can be interpreted either as a subspace approach/blind signal extraction (BSE) approach or as a method for blind system identification (BSI) for single-input and multiple-output (SIMO) systems. As will be described in greater detail below, both interpretations may be utilized in accordance with at least one practical implementation of the overall system of the present disclosure; the BSE for extracting the desired speech signal, and the BSI for the new double-talk control process provided herein.

Specifically, according to FIG. 3, the condition for the cancellation of the acoustic keystroke transients in the output signal $y_1(n)$ is $$h_{21}(n)*w_{11}(n)=-h_{22}(n)*w_{21}(n) \tag{1}$$

It should be noted that in equation (1) the asterisks (*) denote linear convolutions (analogous to the definition in equation (2)). For the case of only one active source signal (e.g., the MIMO de-mixing system reduces to a MISO system), the filter adaptation process simplifies to a form that resembles the well-known supervised adaptation approaches. Moreover, it can be shown that this process performs blind system identification so that, ideally, $w_{11}(n)\propto h_{22}(n)$ and $w_{21}(n)\propto -h_{21}(n)$. These ideal solutions follow from equation (1) as long as $h_{22}(n)$ and $h_{21}(n)$ do not share common zeros in the z-domain and the filter length is sufficiently long for the crosstalk cancellation.

Assuming that the approximate linearity holds in the case of the voice microphones, this semi-blind system-based approach can be expected to work reliably as long as the cancellation filters $w_{11}$ and $w_{21}$ are adapted during the keystroke transients only (additional details about the adaptation control are provided below). The adapted MISO system with output signal $y_1(n)$ then acts as a continuously active spatiotemporally selective filter on the keystroke transients and the desired speech signal.

Semi-Blind Adaptive SIMO Filter Structure with Equalizing Post-Filter

Since in general, during speech activity, the desired signal $s_1(n)$ is also filtered by the same MISO FIR filters (which can be estimated during the activity of the keystrokes, for example, by the simplified cancellation process described in the previous section above), it is straightforward to add an additional equalization filter to the output signal $y_1$ to remove any remaining linear distortions. This single-channel equalizing filter will not change the signal extraction performance. For example, in accordance with one or more embodiments of the present disclosure, the design of such a filter could be based on an approximate inversion of one of the filters in the example system 300, for example, filter $w_{11}$. Such an example design is also in line with the so-called minimum-distortion principle.

Having designed an approximate inverse filter of $w_{11}$, the overall system can be further simplified by moving this inverse filter into the two paths $w_{11}$ and $w_{21}$. This equivalent formulation results in a pure delay by D samples (instead of the adaptive filter $w_{11}$) and a single modified filter $w'_{21}$, respectively, as represented by the solid lines in the system shown in FIG. 6 (which will be described in greater detail below). To ensure causality of the adaptive filter $W'_{21}$ for arbitrary speaker positions, the delay may be selected as D=[L/2].

An Efficient Realization and Control of the Adaptation

Having identified promising candidates for an optimal system-based approach according to the above requirements (i)-(vi), the following sections describe an efficient practical realization and control of the adaptation, in accordance with one or more embodiments of the present disclosure.

Broadband Block-Online Frequency-Domain Adaptation

To thoroughly describe the various features and embodiments of the broadband adaptive method and system of the present disclosure, it is necessary to first introduce a computationally efficient frequency-domain formulation of the above filter structures. This formulation, including the notations of the related quantities, will be the basis for the description of the broadband adaptive method and system that follows. An important feature of this frequency-domain framework is that it increases the efficiency of both the adaptation processes (e.g., approximate diagonalization of the Hessian) and the filtering process (e.g., fast convolution by exploiting the efficiency of the FFT).

The following describes various features and examples of the adaptive methods and systems in the context of partitioned blocks, that is, the (integer) block length N=L/K can be a fraction of the filter length L. This decoupling of L and N is especially desirable for handling highly non-stationary signals such as the keystroke transients addressed by the methods and systems described herein.

Consider the input-output relationship for one of the individual sub-filters $w_{pq}$ according to the example block diagram shown in FIG. 3. The output signal of this sub-filter at time n reads $$y_{qp}(n)=\sum_{l=0}^{L-1} x_p(n-l)w_{pq,l}, \tag{2}$$

where $w_{pq,l}$ are the coefficients of the filter impulse response $w_{pq}$. By partitioning the impulse response $w_{pq}$ of length L into K segments of integer length N=L/K, equation (2) can be written as $$\begin{aligned} y_{qp}(n) &= \sum_{k=0}^{K-1}\sum_{l=0}^{N-1} x_p(n-Nk-l)w_{pq,Nk+l} \\ &= \sum_{k=0}^{K-1} x_{p,k}^T(n)w_{pq,k} = x_p^T(n)w_{pq}, \end{aligned} \tag{3}$$

where $$x_{p,k}(n)=[x_p(n-Nk),x_p(n-Nk-1), \ldots , x_p(n-Nk-N+1)]^T, \tag{4}$$

$$w_{pq,k}=[w_{pq,Nk},w_{pq,Nk+1}, \ldots , w_{pq,Nk+N-1}]^T, \tag{5}$$

$$x_p(n)=[x_{p,0}^T(n),x_{p,1}^T(n), \ldots , x_{p,K-1}^T(n)]^T. \tag{6}$$

Superscript T denotes transposition of a vector or a matrix. The length-N vectors $w_{pq,k}$, k=0, . . . , K−1 represent sub-filters of the partitioned tap-weight vector $$w_{pq}=[w_{pq,0}^T, \ldots , w_{pq,K-1}^T]^T. \tag{7}$$

The block output signal of length N may now be defined. Based on equation (3), presented above, $$y_{qp}(m)=\sum_{k=0}^{K-1} U_{p,k}^T(m)w_{pq,k}, \tag{8}$$

where m is the block time index, and $$y_{qp}(m)=[y_{qp}(mN), \ldots , y_{qp}(mN+N-1)]^T, \tag{9}$$

$$U_{p,k}(m)=[x_{p,k}(mN), \ldots , x_{p,k}(mN+N-1)]. \tag{10}$$

To derive the frequency-domain procedure, the block output signal (equation (8)) is transformed to its frequency-domain counterpart (e.g., using a discrete Fourier Transform (DFT) matrix). The matrices $U_{p,k}(m)$, k=0, . . . , K−1 are Toeplitz matrices of size (N×N). Since a Toeplitz matrix $U_{p,k}(m)$ can be transformed, by doubling its size, to a circulant matrix of size (2N×2/N), and a circulant matrix can be diagonalized using the (2N×2/N)-DFT matrix $F_{2N}$ with elements $e^{-j2\pi vn/(2N)}$ (v, n=0, . . . , 2N−1), this gives $$U_{p,k}^{T}(m)=W_{N\times 2N}^{01}F_{2N}^{-1}X_{p,k}(m)F_{2N}W_{2N\times N}^{10}$$

with the diagonal matrices $$X_{p,k}(m)=\mathrm{diag}\{F_{2N}[x_p(mN-Nk-N), \ldots, x_p(mN-Nk+N-1)]^T\} \tag{11}$$

and the window matrices $W_{N\times 2N}^{01}$ and $W_{2N\times N}^{10}$ as defined in Table 1, illustrated below.

TABLE 1

| Definition of window matrices: |
|---|
| $W_{N\times 2N}^{01} = [O_{N\times N} \quad I_{N\times N}]$<br>$W_{2N\times N}^{10} = [I_{N\times N} \quad O_{N\times N}]^T$ |
| $W_{2N\times 2N}^{01} = \begin{bmatrix} O_{N\times N} & O_{N\times N} \\ O_{N\times N} & I_{N\times N} \end{bmatrix}$ |
| $G_{2N\times 2N}^{01} = F_{2N}W_{2N\times 2N}^{01}F_{2N}^{-1}$ |
| $W_{2N\times 2N}^{10} = \begin{bmatrix} I_{N\times N} & O_{N\times N} \\ O_{N\times N} & O_{N\times N} \end{bmatrix}$ |
| $\tilde{G}_{2N\times 2N}^{10} = F_{2N}W_{2N\times 2N}^{10}F_{2N}^{-1}$<br>$G_{2L\times 2L}^{10} = \mathrm{diag}\{\tilde{G}_{2N\times 2N}^{10}, \ldots, \tilde{G}_{2N\times 2N}^{10}\}$ |

This finally leads to the following block output signal of the pq-th filter:

$$y_{qp}(m)=W_{N\times 2N}^{01}F_{2N}^{-1}X_p(m)\underline{w}_{pq}, \tag{12}$$

where $$X_p(m)=[X_{p,0}(m), X_{p,1}(m), \ldots, X_{p,K-1}(m)], \tag{13}$$

$$\underline{w}_{pq}=[\underline{w}_{pq,0}^{T}, \ldots, \underline{w}_{pq,K-1}^{T}]^T, \tag{14}$$

$$\underline{w}_{pq,k}=F_{2N}W_{2N\times N}^{10}w_{pq,k}. \tag{15}$$

Based on the compact expressions of equation (12) for p=1, 2, 3, and q=1, 2, the output signal blocks (e.g., $y_1$, $y_2$ in the example shown in FIG. 3 and described above) and/or the error signal blocks needed for the optimization criterion may be readily obtained by a superposition of these signal vectors. For example, the block error signal e(m) to adapt the filter $w'_{21}$ in the simplified structure of the example system shown in FIG. 6 reads $$e(m)=x_1(m)-W_{N\times 2N}^{01}F_{2N}^{-1}X_2(m)\underline{w}'_{21}, \tag{16}$$

where $x_1(m)$ denotes a length-N block of the microphone signal $x_1(n)$, delayed by D samples. Similarly, the adaptation method of the original blind SIMO system identification-based approach described above can be expressed using an error signal vector in which the delayed reference signal $x_1(m)$ in equation (16) is replaced by another adaptive sub-filter term according to equation (12), that is $$e_{AED}(M)=W_{N\times 2N}^{01}F_{2N}^{-1}[X_1(m)\underline{w}_{11}+X_2(m)\underline{w}_{21}]. \tag{17}$$

In accordance with at least one embodiment, the implementation presented in Table 2 (below) may be based on the block-by-block minimization of the error signal of equation (16) with respect to the frequency-domain coefficient vector $w'_{21}$. In accordance with at least one other embodiment, an analogous formulation (which is described in greater detail below and in Table 2) may be used which minimizes the error signal of equation (17) with respect to the combined coefficient vector $\underline{w}:=[\underline{w}_{11}^{T}, \underline{w}_{21}^{T}]^T$.

Robust Statistics

Having expressed the error signal in a compact partitioned-block frequency-domain notation, the following provides a suitable block-based optimization criterion in accordance with one or more embodiments of the present disclosure. As described above, this filter optimization should be performed during the exclusive activity of keystroke transients (and inactivity of speech or other signals in the acoustic environment). Once a suitable block-based optimization criterion is established, the following description will also provide details about the new fast-reacting transient noise detection system and method of the present disclosure, which is tailored to the semi-blind scenario according to FIG. 6 in reverberant environments.

For ease of explanation, the following features and examples are described in the context of the single-talk situation with keystroke transient activity. Most common adaptation methods are least-squares-based and among these the recursive least-squares (RLS) method is known to exhibit the fastest initial convergence speed, which is an important property in the present context in which the very short keystroke transients act as excitation signals to the adaptation. To obtain a computationally efficient implementation, the following description works with an RLS-like frequency-domain adaptive filter (FDAF) with an O(log L) complexity per sample. This broadband adaptation scheme in the DFT domain, based on the above partitioned-block error (which is also sometimes called "multidelay filter") formulation is known to retain many of the desirable RLS-type convergence properties.

Moreover, as ensuring the robustness of the adaptation during double talk is particularly crucial for fast-converging procedures like RLS, in accordance with one or more embodiments, the methods and systems of the present disclosure additionally apply the concept of robust statistics within this frequency-domain framework the (semi-)blind scenario. Robust statistics is an efficient technique to make estimation processes inherently less sensitive to occasional outliers (e.g., short bursts that may be caused by rare but inevitable detection failures of adaptation controls). To ensure fast convergence (as with the original non-robust approach) while at the same time avoid sudden divergence in such a situation which can essentially be described by a modified, super-Gaussian (e.g., heavy-tailed) background noise probability distribution function (pdf), the robust adaptation methods and systems of the present disclosure consist of at least the following, each of which will be described in greater detail below:

(1) robust adaptive filter estimation using a modified optimization criterion, and (2) adaptive (e.g., time varying) scale factor estimation.

Robust Adaptive Filter Estimation

Modeling the noise with a super-Gaussian probability distribution function to obtain an outlier-robust technique corresponds to a non-quadratic optimization criterion. Following the block-based weighted least-squares criterion is generalized to a corresponding M-estimator:

$$J(m, \underline{w}) = \sum_{i=0}^{m} \beta(i, m) \sum_{n=iN}^{iN+N-1} \rho\left[\frac{|e(n)|}{s_\rho}\right], \tag{18}$$

where β(i, m) is a weighting function defining different classes of methods, e.g., $\beta(i, m)=(1-\lambda)\lambda^{m-i}$ with the forgetting factor $0<\lambda<1$ to obtain an RLS-like method, and e(iN), . . . , e(iN+N−1) denote the elements of the signal vector e(i) (according to the description above for the broadband block-online frequency-domain adaptation) with block index i. It should be noted that $$\rho\left[\frac{|e(n)|}{s_\rho}\right] = |e(n)|^2$$

gives the corresponding non-robust approach. In general, p(•) is a convex function and $s_\rho$ is a real-valued positive scale factor for the i-th block (as further described below). One of the main statements of the theory on robust statistics is that the resulting process inherits robust properties as long as the nonlinear function p(•) has a bounded derivative. It can easily be verified that the condition of a bounded derivative is not fulfilled for the classical case $p(\bullet)=|\bullet|^2$.

A particularly simple yet efficient choice of p(•) for robustness is given by the so-called Huber estimator:

$$\rho(|z|) = \begin{cases} \frac{|z|^2}{2}, & \text{for } |z| \le k_0, \\ k_0|z| - \frac{k_0^2}{2}, & \text{for } |z| \ge k_0, \end{cases} \tag{19}$$

where $k_0>0$ is a constant controlling the robustness of the process. The derivative of p (•) for the Huber estimator, $$\psi(|z|) := \rho'(|z|) = \begin{cases} |z|, & \text{for } |z| \le k_0, \\ k_0, & \text{for } |z| \ge k_0, \end{cases} \tag{20}$$

$$= \min\{|z|, k_0\},$$

clearly fulfills the boundedness requirement and it may be shown that the choice in equation (19) gives the optimum equivariant robust estimator under the assumption of Gaussian background noise.

Table 2, below, illustrates pseudocode of an example method based on the system configuration shown in FIG. 6, the optimization criterion of equation (18), and the multi-delay formulation in equation (16), in accordance with one or more embodiments described herein. As shown in FIG. 6, in accordance with at least one embodiment, the overall system 600 may include a foreground filter 620 (e.g., the main adaptive filter producing the enhanced output signal $y_1$, as described above), as well as a separate background filter 640 (denoted by dashed lines) that may be used for controlling the adaptation of the foreground filter 620. These two components (the foreground filter 620 and background filter 640) are also represented by the two lowermost (main) sections in the pseudocode shown in Table 2.

TABLE 2

Input signals:

$x_1(m) = [x_1(mN - D), \ldots, x_1(mN - D + N - 1)]^T$ (21a)

$X_{2,k}(m) = \mathrm{diag}\{F_{2N}[x_2(mN - Ni - N), \ldots, x_2(mN - Ni + N - 1)]^T\}$, $k = 0, \ldots, K - 1$ (21b)

$X_2(m) = [X_{2,0}(m), X_{2,1}(m), \ldots, X_{2,K-1}(m)]$ (21c)

$\underline{x}_3(m) = F_{2N}[O_{1\times N}, x_3(mN - D), \ldots, x_3(mN - D + N - 1)]^T$ (21d)

TABLE 2-continued

Kalman gain:

$S'(m) = \lambda S'(m - 1) + (1 - \lambda)X_2^H(m)X_2(m)$ (21e)

$K(m) = S'^{-1}(m)X_2^H(m)$ (21f)

Double-talk detector (background filter):

$\underline{w}_b^0(m) := \underline{w}_b(m - 1)$ for $l = 1, \ldots, l_{max_sys,back}$:

$\underline{e}_b^l(m) = \underline{x}_3(m) - G_{2N\times 2N}^{01}X_2(m)\underline{\hat{W}}_b^{l-1}(m)$ (21g)

$\underline{w}_b^l(m) = \underline{w}_b^{l-1}(m) + \mu_b 2(1 - \lambda_b)G_{2L\times 2L}^{10}K(m)\underline{e}_b^l(m)$ (21h)

end for $\underline{w}_b'(m) := \underline{w}_b^{l_{max,sys,back}}(m)$ $\sigma_{x_3}^2(m) = \lambda_b\sigma_{x_3}^2(m - 1) + (1 - \lambda_b)\underline{x}_3^H(m)\underline{x}_3(m)$ (21i)

$s_k(m) = \lambda_b s_k(m - 1) + (1-\lambda_b)X_{2,k}^*(m)\underline{x}_3(m)$, $k = 0, \ldots, K - 1$ (21j)

$$\xi_1(m) = \frac{\sum_{k=0}^{K-1} \underline{w}_{b,k}'^H(m)s_k(m)}{\sigma_{\tilde{x}_3}^2(m)} \tag{21k}$$

$w_b'(m) = \mathrm{diag}\{W_{N\times 2N}^{01}F_{2N}^{-1}, \ldots, W_{N\times 2N}^{01}F_{2N}^{-1}\} \times \underline{w}_b'(m)$ (21l)

$w_b(m) = (1 - 2\lambda_r\mu_b)w_b'(m) - 2\lambda_r\mu_b(b_r(m - 1) - d_r(m - 1))$ (21m)

$[d_r(m)]_n = \Phi([w_b(m) + b_r(m - 1)]_n, \rho_r/2\lambda_r)$, $n = 1, \ldots, N$ (21n)

$b_r(m) = b_r(m - 1) + w_b(m) - d_r(m)$ (21o)

$$\xi_2(m) = \frac{\max_{a\le i\le b}|w_{b,i}(m)|}{\max_{b<i\le c}|w_{b,i}(m)|} \tag{21p}$$

$\underline{w}_b(m) = \mathrm{diag}\{F_{2N}W_{2N\times N}^{10}, \ldots, F_{2N}W_{2N\times N}^{10}\} \times w_b(m)$ (21q)

if $\xi_1 \ge T_1$ & $\xi_2 < T_2$ & $\sigma_{x_3}^2(m) > T_3$ $\mu' = \mu(1 - \lambda)$ ('single-talk' ⇒ adapt foreground) (21r)

else $\mu' = 0$ ('double-talk' ⇒ don't adapt foregr.)

end if

Keystroke transient canceller (foreground filter):

$\underline{w}^0(m) := \underline{w}(m - 1)$ for $l = 1, \ldots, l_{max_sys}$:

$e^l(m) = x_1(m) - W_{N\times 2N}^{01}F_{2N}^{-1}X_2(m)\underline{w}^{l-1}(m)$ (21s)

$$[\tilde{\psi}(e^l(m))]_n = \psi\left(\frac{|[e^l(m)]_n|}{s_\rho(m)}\right)\mathrm{sign}([e^l(m)]_n), \quad n = 1, \ldots, N \tag{21t}$$

$$\psi_{min}'(m) = \max\left[\mu, \min_{1\le n\le N}\left\{\psi'\left(\frac{|[e^l(m)]_n|}{s_\rho(m)}\right)\right\}\right] \tag{21u}$$

$$\underline{w}^l(m) = \underline{w}^{l-1}(m) + \frac{\mu' s_\rho(m)}{\psi_{min}'(m)}G_{2L\times 2L}^{10}K(m) \times F_{2N}W_{2N\times N}^{01}\tilde{\psi}(e^l(m)) \tag{21v}$$

end for $\underline{w}(m) := \underline{w}^{l_{max,sys}}(m)$ (21w)

for $l = l_{max_sys} + 1, \ldots, l_{max}$:

$e^l(m) = x_1(m) - W_{N\times 2N}^{01}F_{2N}^{-1}X_2(m)\underline{w}^{l-1}(m)$ (21x)

$\underline{w}^l(m) = \underline{w}^{l-1}(m) + \mu' K(m)F_{2N}W_{2N\times N}^{01T}e^l(m)$ (21y)

end for $y_1(m) := e^{l_{max}}(m)$ $$s_\rho(m + 1) = \lambda_s s_\rho(m) + (1 - \lambda_s)\frac{s_\rho(m)}{N\beta}\sum_{n=mN}^{mN+N-1}\psi\left(\frac{|y_1(n)|}{s_\rho(m)}\right) \tag{21z}$$

With reference to Table 2, above, attention is focused on the foreground filter (equations (21s)-(21y)) in the last section in the pseudocode, including the necessary Kalman gain (equations (21e) and (21f)) (which is used for computational efficiency for both the foreground filter and background filter due to their common input signal $X_2(m)$), and the required input signals (equations (21a)-(21c)). A derivation of this robust frequency-domain adaptation method based directly on the above criterion is known to those skilled in the art. It should be noted that $[a]_n$ denotes the n-th element of a vector a (e.g., in equation (21t)). Also, the background filter for adaptation control will be described in greater detail below.

In accordance with one or more embodiments of the present disclosure, an important feature of the example implementation according to Table 2, in order to further speed up the convergence, are the additional offline iterations (denoted by index $\ell$) in each block. Although such block-wise offline iterations may be more common in blind adaptive filtering, the method carries over directly to the supervised case. Indeed, in the case of supervised adaptive filtering, this approach is particularly efficient as the entire Kalman gain computation only depends on the sensor signal (meaning that the Kalman gain needs to be calculated only once per block). Moreover, in accordance with at least one embodiment, to avoid the undesirable "overlearning" phenomenon for a high number of offline iterations with this method, yet allow to a certain degree for the exploitation of the method's rapid tracking capability of local signal statistics, the total number $l_{max}$ of offline iterations may be subdivided into two steps, as described in the following:

(1) During the first $\ell_{max,sys}$ iterations (where $1 \leq \ell_{max,sys} << \ell_{max}$), the goal of the adaptation is strictly system-based. The resulting set of filter coefficients $\underline{w}(m) := \underline{w}^{\ell_{max,sys}}(m)$ after these iterations (see equation (21w) in Table 2, above) are thus considered to be valid globally from one signal block to the next. Therefore, in order to obtain a robust, generalizable estimate, the method of robust statistics may be applied during these iterations.

(2) In the second set of iterations $\ell = \ell_{max,sys}+1, \ldots, l_{max}$, the strict system-based goal may be relaxed. This second set of iterations produces the final output signal block $Y_1(m) := e^{\ell_{max}}(m)$, but the resulting set of filter coefficients is not carried over to the processing of the next signal block. In other words, this second step can be regarded as a postfiltering stage. It turns out that while in the extreme case $\ell_{max} \rightarrow \infty$ the approach resembles the well-known Wiener postfilter (e.g., see equation (23) below), there are a number of differences that should be understood. First, the choice of $\ell_{max}$ provides a tradeoff parameter on the incorporation of parameter estimates from previous signal blocks. As long as $\ell_{max} < \infty$, the previous parameter estimates are taken into account, as illustrated by the generic expression of equation (22). Secondly, in contrast to most conventional bin-wise Wiener postfiltering implementations (typically in short-time Fourier transform (STFT) domains), the postfilter resulting from the additional offline iterations is still based on a broadband optimization, as reflected by the constraint matrices in equation (22). This broadband property can be seen even in the extreme case $\ell_{max} \rightarrow \infty$ in equation (23), in which the inverted 2 L×2 L matrix is not strictly sparse due to the matrix $G_{2N \times 2N}^{01}$. Despite these features, the iterative realization after the example method provided in Table 2 is nonetheless computationally efficient due to, among other things, the O(log L) complexity of the update equations in the frequency domain and the fact that the Kalman gain computation (equations (21e) and (21j) in Table 2) need only be carried out once for all iterations.

It should be noted that the method of using offline iterations is particularly efficient with the multi-delay (e.g., partitioned) filter model, which allows the decoupling of the filter length L and the block length N. Such a model is attractive in the application of the present disclosure with highly nonstationary keystroke transients, as the multi-delay model further improves the tracking capability of the local signal statistics.

It should also be understood that all of the building blocks thus far described may carry-over to any or all of the example overall system structures described above with respect to keystroke transient cancellation based on broadband adaptive MIMO filtering.

Scale Factor Estimation

Besides the estimation of the filter coefficient vector $\underline{w}$, the scaling factor $s_\rho$ is the other main ingredient of the method of robust statistics (see equation (18) above), and is a suitable estimate of the spread of the random errors. In practice, $s_\rho$ may be obtained from the residual error, which in turn depends on $\underline{w}$. In accordance with one or more embodiments of the present disclosure, the scale factor should, for example, reflect the background noise level in the local acoustic environment, be robust to short error bursts during double-talk, and track long-term changes of the residual error due to changes in the acoustic mixing system (e.g., impulse responses $h_{qp}$ in the example system shown in FIG. 6 and described above), which may be caused by, for example, speaker movements. In accordance with at least one embodiment described herein, a corresponding block formulation for a block length N is applied in equation (21z) in Table 2, where $s_\rho(0)=\sigma_x$ and $\beta$ is a normalization constant depending on $k_0$.

Semi-blind Multi-Delay Double-Talk Detection

The previous sections developed and described at least one example of the overall system architecture based on the requirements (i)-(vi) presented earlier, and also developed and described the main part of the adaptive keystroke transient canceller in accordance with at least one embodiment of the present disclosure (e.g., the last part of the pseudocode in Table 2). As such, the following sections now describe details about various features and aspects of controlling the adaptation (e.g., using a double-talk detector (first main part in Table 2)) in accordance with one or more embodiments of the present disclosure. In the following, a reliable decision mechanism is developed and described so that the adaptation of the keystroke transient canceller is performed only during the exclusive activity of the keystroke transients.

For example, the considerations underlying the following description may be based on the semi-blind system structure of the present disclosure exploiting the keyboard reference microphone (e.g., of a portable computing device, such as, for example, a laptop computer) for keystroke transient detection, as described earlier sections above. However, despite the availability of the keyboard reference microphone, it turns out that in at least the present scenario a reliable adaptation control is a more challenging task than the adaptation control problem for the well-known supervised adaptive filtering case (e.g., for acoustic echo cancellation). This is mainly due to the noticeable cross-talk of the desired speech signal into the keyboard reference microphone, as well as the very significant nonlinear components in the propagation paths of the keystroke transients (e.g., requirements (iii)-(v) described above). Hence, a single power-based or correlation-based decision statistic, which is utilized in existing approaches, will not be sufficient in this case.

Instead, the present disclosure provides a novel adaptation control based on multiple decision criteria which also exploit the spatial selectivity by the multiple microphone channels. In at least some respects, the resulting method may be regarded as a semi-blind generalization of a multi-delay-based detection mechanism. In accordance with one or more embodiments, the criteria that may be integrated in the adaption control include, for example, power of the keyboard reference signal, nonlinearity effect, and approximate blind mixing system identification and source localization, each of which are further described below.

Due to the proximity between the keyboard and the reference microphone directly underneath, the signal power $\sigma_{x_3}^2(m)$ of the keyboard reference signal according to equation (21i) (shown in Table 2 above) typically gives a very reliable indication of the activity of keystrokes. In order to ensure a quick reaction of the detector, the block length N is chosen to be shorter than the filter length L using the multi-delay filter model. Moreover, the forgetting factor $\lambda_b$ should be smaller than the forgetting factor $\lambda$. The choice of the forgetting factor (between 0 and 1) essentially defines an effective window length for estimating the signal power. A smaller forgetting factor corresponds to a short window length and, hence, to a faster tracking of the (time-varying) signal statistics.

It should be understood that in order to decide about the exclusive activity of keystrokes, this first criterion should be complemented by further criteria, which are described in detail below. Somewhat similar to the known foreground-background structure based on supervised adaptive filters, in at least one embodiment the adaptation control of the present disclosure carries over this foreground-background structure to the blind/semi-blind case. As will be shown below, the use of an adaptive filter in the background provides various opportunities for synergies among the computations of the different detection criteria.

In addition to the short-time signal power $\sigma_{x_3}^2(m)$ as a first detection variable, the detection variable $\xi_1$ describes the ratio of a linear approximation to the nonlinear contribution in $x_3$.

One of the more important criteria is described by the detection variable $\xi_2$. This criterion can be understood as a spatio-temporal source signal activity detector. It should be noted that both of the detection variables $\xi_1$ and $\xi_2$ are based on the adaptive background filter (similar to the foreground filter, but with slightly larger stepsize and smaller forgetting factor for quick reaction of the detection mechanism).

The detection variable $\xi_2$ exploits the microphone array geometry. According to the example physical arrangement illustrated in FIG. 6, it can safely be assumed that the direct path of $h_{23}$ will be significantly shorter than the direct path of $h_{13}$. Due to the relation of the maxima of the background filter coefficients and the time difference of arrival, an approximate decision on the activity of both sources $s_1$ and $s_2$ can be made ($1 \le a < b < c \le L$ in equation (21p), as set forth in Table 2, above). In accordance with at least one embodiment, to further improve the detection accuracy a regularization for sparse learning of the background filter coefficients may be applied (equations (21m)-(21o), where $\Phi(\bullet, a)$ denotes a center clipper, which is also known as a shrinkage operator, of width a).

Figure 8:
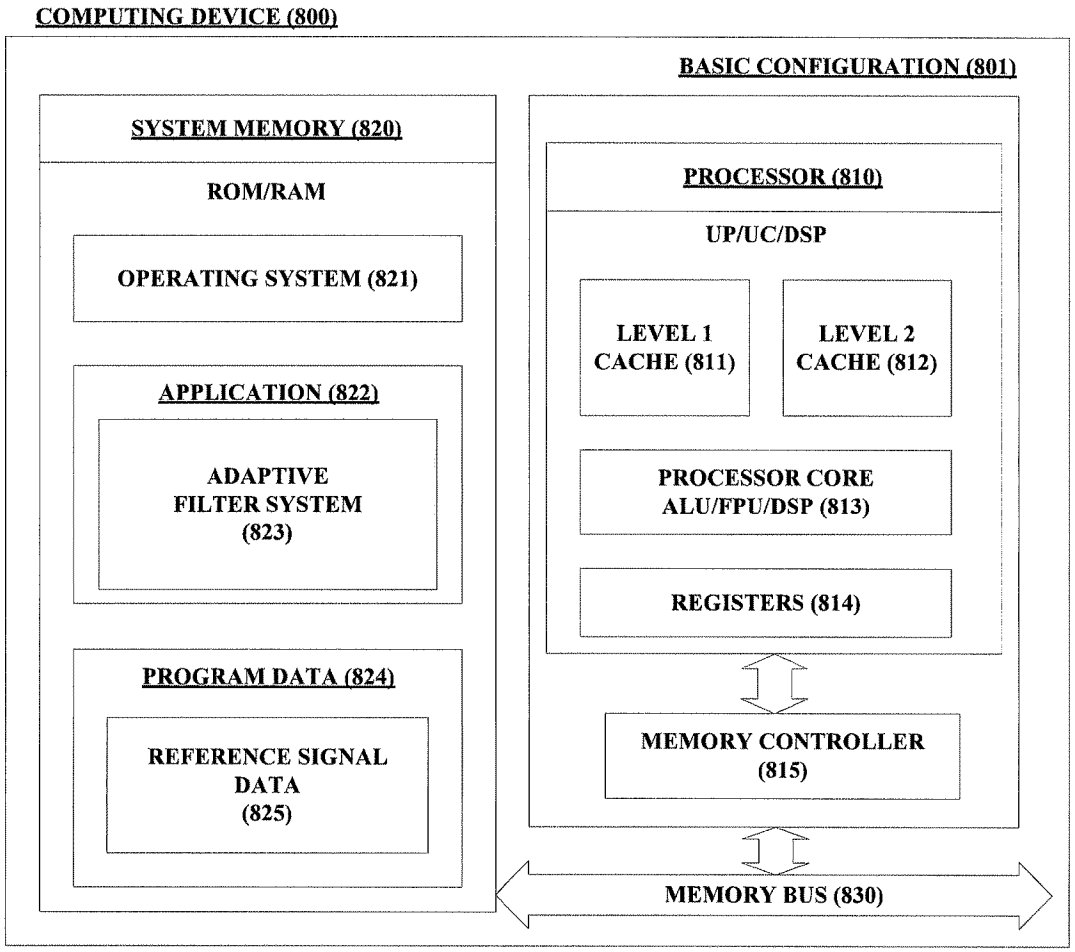
FIG. 8 is a block diagram illustrating an example computing device arranged for semi-supervised acoustic keystroke transient suppression according to one or more embodiments described herein.

FIG. 8 is a high-level block diagram of an exemplary computer (800) arranged for acoustic keystroke transient suppression/cancellation using semi-blind adaptive filtering, according to one or more embodiments described herein. In accordance with at least one embodiment, the computer (800) may be configured to perform adaptation control of a filter based on multiple decision criteria that exploit spatial selectivity by multiple microphone channels. Examples of criteria that may be integrated into the adaption control include the power of a reference signal provided by a keybed microphone, nonlinearity effects, and approximate blind mixing system identification and source localization. In a very basic configuration (801), the computing device (800) typically includes one or more processors (810) and system memory (820). A memory bus (830) can be used for communicating between the processor (810) and the system memory (820).

Depending on the desired configuration, the processor (810) can be of any type including but not limited to a microprocessor (μP), a microcontroller (μC), a digital signal processor (DSP), or any combination thereof. The processor (810) can include one more levels of caching, such as a level one cache (811) and a level two cache (812), a processor core (813), and registers (814). The processor core (813) can include an arithmetic logic unit (ALU), a floating point unit (FPU), a digital signal processing core (DSP Core), or any combination thereof. A memory controller (815) can also be used with the processor (810), or in some implementations the memory controller (815) can be an internal part of the processor (810).

Depending on the desired configuration, the system memory (820) can be of any type including but not limited to volatile memory (such as RAM), non-volatile memory (such as ROM, flash memory, etc.) or any combination thereof. System memory (820) typically includes an operating system (821), one or more applications (822), and program data (824). The application (822) may include Adaptive Filter System (823) for selectively suppressing/cancelling transient noise in audio signals containing voice data using adaptive finite impulse response (FIR) filters, in accordance with one or more embodiments described herein. Program Data (824) may include storing instructions that, when executed by the one or more processing devices, implement a method for acoustic keystroke transient suppression/cancellation using semi-blind adaptive filtering.

Additionally, in accordance with at least one embodiment, program data (824) may include reference signal data (825), which may include data (e.g., power data, nonlinearity data, and approximate blind mixing system identification and source localization data) about a transient noise measured by a reference microphone (e.g., reference microphone 115 in the example system 100 shown in FIG. 1). In some embodiments, the application (822) can be arranged to operate with program data (824) on an operating system (821).

The computing device (800) can have additional features or functionality, and additional interfaces to facilitate communications between the basic configuration (801) and any required devices and interfaces.

System memory (820) is an example of computer storage media. Computer storage media includes, but is not limited to, RAM, ROM, EEPROM, flash memory or other memory technology, CD-ROM, digital versatile disks (DVD) or other optical storage, magnetic cassettes, magnetic tape, magnetic disk storage or other magnetic storage devices, or any other medium which can be used to store the desired information and which can be accessed by computing device 800. Any such computer storage media can be part of the device (800).

The computing device (800) can be implemented as a portion of a small-form factor portable (or mobile) electronic device such as a cell phone, a smart phone, a personal data assistant (PDA), a personal media player device, a tablet computer (tablet), a wireless web-watch device, a personal headset device, an application-specific device, or a hybrid device that include any of the above functions. The computing device (800) can also be implemented as a personal computer including both laptop computer and non-laptop computer configurations.

The foregoing detailed description has set forth various embodiments of the devices and/or processes via the use of block diagrams, flowcharts, and/or examples. Insofar as such block diagrams, flowcharts, and/or examples contain one or more functions and/or operations, it will be understood by those within the art that each function and/or operation within such block diagrams, flowcharts, or examples can be implemented, individually and/or collectively, by a wide range of hardware, software, firmware, or virtually any combination thereof. In accordance with at least one embodiment, several portions of the subject matter described herein may be implemented via Application Specific Integrated Circuits (ASICs), Field Programmable Gate Arrays (FPGAs), digital signal processors (DSPs), or other integrated formats. However, those skilled in the art will recognize that some aspects of the embodiments disclosed herein, in whole or in part, can be equivalently implemented in integrated circuits, as one or more computer programs running on one or more computers, as one or more programs running on one or more processors, as firmware, or as virtually any combination thereof, and that designing the circuitry and/or writing the code for the software and or firmware would be well within the skill of one of skill in the art in light of the present disclosure.

In addition, those skilled in the art will appreciate that the mechanisms of the subject matter described herein are capable of being distributed as a program product in a variety of forms, and that an illustrative embodiment of the subject matter described herein applies regardless of the particular type of non-transitory signal bearing medium used to actually carry out the distribution. Examples of a non-transitory signal bearing medium include, but are not limited to, the following: a recordable type medium such as a floppy disk, a hard disk drive, a Compact Disc (CD), a Digital Video Disk (DVD), a digital tape, a computer memory, etc.; and a transmission type medium such as a digital and/or an analog communication medium (e.g., a fiber optic cable, a waveguide, a wired communications link, a wireless communication link, etc.).

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity.

Thus, particular embodiments of the subject matter have been described. Other embodiments are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A system for suppressing transient noise, the system comprising:

a plurality of input sensors that input audio signals captured from one or more sources, wherein the audio signals contain voice data and transient noise captured by the input sensors;

a reference sensor that inputs a reference signal containing data about the transient noise, wherein the reference sensor is located separately from the input sensors;

a semi-blind adaptive single-input and multi-output (SIMO) filtering structure that includes:

a plurality of filters that selectively filter the transient noise from the audio signals to extract the voice data based on the data contained in the reference signal, and output an audio signal containing the extracted voice data; and a single-channel equalizing post-filter that filters linear distortion from the audio signal containing the extracted voice data and that outputs an enhanced audio single containing the extracted voice data, wherein the single-channel equalizing post-filter includes a filter that is an inversion of one of the plurality of filters.

2. The system of claim 1, wherein each of the plurality of filters is a broadband finite impulse response filter.

3. The system of claim 1, wherein the plurality of filters include:

an adaptive foreground filter; and an adaptive background filter, wherein the foreground filter adaptively filters the transient noise to produce the output audio signal, and the background filter controls the adaptation of the foreground filter.

4. The system of claim 3, wherein the background filter controls the adaptation of the foreground filter based on the data contained in the reference signal.

5. The system of claim 3, wherein the background filter controls the adaptation of the foreground filter in response to transient noise being detected in the audio signals.

6. The system of claim 3, wherein the background filter controls the adaptation of the foreground filter based on one or more of a power of the reference signal, a ratio of a linear approximation to a nonlinearity contribution of the reference signal, and spatio-temporal source signal activity data associated with the reference signal.

7. The system of claim 3, wherein the background filter controls the adaptation of the foreground filter based on a power of the reference signal, a ratio of a linear approximation to the nonlinearity contribution of the reference signal, and spatio-temporal source signal activity data associated with the reference signal.

8. The system of claim 1, wherein the transient noise contained in the audio signals is a keystroke noise generated from a keybed of a user device.

9. The system of claim 1, wherein the input sensors and the reference sensor are microphones.

10. The system of claim 1, wherein the plurality of filters filter the transient noise from the audio signals by subtracting the reference signal input from the reference sensor.

11. A method for suppressing transient noise, the method comprising:

receiving, from a plurality of input sensors, input audio signals captured from one or more sources, wherein the audio signals contain voice data and transient noise captured by the input sensors;

receiving, from a reference sensor, a reference signal containing data about the transient noise, wherein the reference sensor is located separately from the input sensors;

selectively filtering the transient noise from the audio signals to extract the voice data based on the data contained in the reference signal;

outputting an audio signal containing the extracted voice data;

filtering, by a single-channel equalizing post filter, linear distortion from the audio signal containing the extracted voice data, wherein the single-channel equalizing post-filter includes a filter that is an inversion of the plurality of filters; and outputting an enhanced audio single containing the extracted voice data.

12. The method of claim 11, wherein the transient noise is selectively filtered from the audio signals using broadband finite impulse response filters.

13. The method of claim 11, further comprising:

adapting a foreground filter to adaptively filter the transient noise to produce the output audio signal.

14. The method of claim 13, further comprising:

controlling the adaptation of the foreground filter using a background filter.

15. The method of claim 14, wherein the background filter controls the adaptation of the foreground filter based on the data contained in the reference signal.

16. The method of claim 14, wherein the background filter controls the adaptation of the foreground filter in response to transient noise being detected in the audio signals.

17. The method of claim 14, wherein the background filter controls the adaptation of the foreground filter based on one or more of a power of the reference signal, a ratio of a linear approximation to a nonlinearity contribution of the reference signal, and spatio-temporal source signal activity data associated with the reference signal.

18. The method of claim 14, wherein the background filter controls the adaptation of the foreground filter based on a power of the reference signal, a ratio of a linear approximation to the nonlinearity contribution of the reference signal, and spatio-temporal source signal activity data associated with the reference signal.

19. The method of claim 11, wherein the transient noise contained in the audio signals is a keystroke noise generated from a keybed of a user device.

20. The method of claim 11, wherein the input sensors and the reference sensor are microphones.

* * * * *